US006610423B2

(12) United States Patent
Sugimaru et al.

(10) Patent No.: US 6,610,423 B2
(45) Date of Patent: Aug. 26, 2003

(54) PLATED STEEL PRODUCT HAVING HIGH CORROSION RESISTANCE AND EXCELLENT FORMABILITY AND METHOD FOR PRODUCTION THEREOF

(75) Inventors: Satoshi Sugimaru, Kimitsu (JP); Satoru Tanaka, Kimitsu (JP); Seiki Nishida, Kimitsu (JP); Akira Takahashi, Kimitsu (JP); Atsuhiko Yoshie, Futtsu (JP); Kazumi Nishimura, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 89 days.

(21) Appl. No.: 10/018,404

(22) PCT Filed: Feb. 28, 2001

(86) PCT No.: PCT/JP01/01529

§ 371 (c)(1),
(2), (4) Date: Oct. 26, 2001

(87) PCT Pub. No.: WO01/64971

PCT Pub. Date: Sep. 7, 2001

(65) Prior Publication Data

US 2003/0003321 A1 Jan. 2, 2003

(30) Foreign Application Priority Data

| | | |
|---|---|---|
| Feb. 29, 2000 | (JP) | 2000-054534 |
| Feb. 29, 2000 | (JP) | 2000-054542 |
| Feb. 29, 2000 | (JP) | 2000-054543 |
| Mar. 31, 2000 | (JP) | 2000-099375 |
| Mar. 31, 2000 | (JP) | 2000-099807 |
| Mar. 31, 2000 | (JP) | 2000-099823 |
| May 2, 2000 | (JP) | 2000-133561 |
| May 8, 2000 | (JP) | 2000-135161 |
| May 8, 2000 | (JP) | 2000-135190 |
| May 22, 2000 | (JP) | 2000-150328 |
| May 22, 2000 | (JP) | 2000-150355 |
| May 22, 2000 | (JP) | 2000-150412 |
| Feb. 20, 2001 | (JP) | 2001-043953 |
| Feb. 20, 2001 | (JP) | 2001-043959 |
| Feb. 20, 2001 | (JP) | 2001-043983 |
| Feb. 20, 2001 | (JP) | 2001-043995 |
| Feb. 20, 2001 | (JP) | 2001-044017 |
| Feb. 20, 2001 | (JP) | 2001-044126 |

(51) Int. Cl.[7] ..... B32B 15/00; B05D 1/18

(52) U.S. Cl. ..... 428/659; 148/533; 427/398.1; 427/398.3; 427/406; 427/432; 427/433; 427/436; 428/457; 428/939

(58) Field of Search ..... 428/659, 457, 428/939, 398.1, 398.3, 406, 432, 433, 436; 148/533

(56) References Cited

U.S. PATENT DOCUMENTS

| | | | |
|---|---|---|---|
| 3,320,040 | A | 5/1967 | Roe et al. |
| 3,505,042 | A | 4/1970 | Sievert et al. |
| 4,605,598 | A | 8/1986 | Thomas et al. |

FOREIGN PATENT DOCUMENTS

| | | |
|---|---|---|
| EP | 0 905 270 | 3/1999 |
| FR | 2 027 888 | 10/1970 |
| GB | 1 125 965 | 9/1968 |
| JP | 0 405 2284 | 2/1992 |
| JP | 7-207421 | 8/1995 |
| JP | 10-226865 | 8/1998 |
| JP | 11-229105 | 8/1999 |
| WO | 00/71773 | 11/2000 |

*Primary Examiner*—Robert R. Koehler
(74) *Attorney, Agent, or Firm*—Kenyon & Kenyon

(57) ABSTRACT

The object of the present invention relates to a plated steel material and a method of production the same, having enhanced corrosion resistance and workability required for outdoor and exposed uses such as structures, revetments, fishing nets, fences, etc., and a method to produce the plated steel material having an alloy layer 20 μm or less in thickness consisting of, in mass, 25% or less of Fe, 30% or less of Al, 5% or less of Mg and the balance consisting of Zn at the interface of a plated layer and a base steel; also relates to a plated steel material and a method of production the same, excellent in corrosion resistance and workability, having, at the interface of a plated layer and a base steel, an alloy layer composed of: an inner alloy layer 5 μm or less in thickness consisting of, in mass, 15% or more of Fe, 20% or more of Al, 2% or more of Si, 5% or less of Mg and the balance consisting of Zn; and an outer alloy layer 30 μm or less in thickness consisting of, in mass, 25% or less of Fe, 30% or less of Al, 2% or more of Si, 5% or less of Mg and the balance consisting of Zn.

31 Claims, 4 Drawing Sheets

PLATED STEEL PRODUCT HAVING HIGH CORROSION RESISTANCE AND EXCELLENT FORMABILITY AND METHOD FOR PRODUCTION THEREOF

TECHNICAL FIELD

This invention relates to a plated steel material having enhanced corrosion resistance and workability, as required for outdoor and exposed uses such as structures, revetments, fishing nets, fences, etc., and a method to produce the plated steel material. The plated steel material includes: plated steel wires such as steel wires for gauze, concrete reinforcing fibers, bridge cables, PWS wires, PC wires, ropes and the like; structural steels such as H sections, sheet pilings and the like; machine components such as screws, bolts, springs and the like; steel sheets and plates; and other steel materials.

BACKGROUND ART

Among plated steel materials, and among plated steel wires in particular, galvanized steel wires and zinc—aluminum alloy plated steel wires, superior to galvanized steel wires in corrosion resistance, are commonly used. The zinc—aluminum alloy plated steel wires are produced, generally, by subjecting a steel wire to the following sequential processes: washing, degreasing, or other means of cleaning; flux treatment; plating by either a two-step plating process consisting of a first step of hot dip plating in a plating bath mainly containing zinc and a second step of hot dip plating in a Zn—Al alloy bath containing 10% of Al or a one-step plating process in a Zn—Al alloy bath containing 10% of Al; then, after the wire vertically extracted from the plating bath, cooling it and winding it into coils.

The good corrosion resistance of a zinc—aluminum alloy plated steel wire is enhanced yet further by increasing the plating thickness. One of the methods to secure a desired plating thickness is to increase the speed of a steel wire (wire speed) at plating operation so that it comes out of a plating bath at a high speed and to increase the amount of the plated alloy adhering to the steel wire owing to the viscosity of the molten plating alloy. By this method, however, the plating thickness of a plated steel wire, in the cross section perpendicular to its longitudinal direction, is likely to become uneven because of the high speed, and therefore there is a limitation related to a plating apparatus. Consequently, galvanizing or hot dip plating of Zn—Al alloy using current plating apparatuses cannot provide sufficient corrosion resistance and there is a problem that today's strong demands for a longer service life of a plated steel wire are not satisfactorily fulfilled.

To cope with the problem, Japanese Unexamined Patent Publication No. H10-226865 proposes a plating composition of a Zn—Al—Mg alloy system, wherein corrosion resistance is enhanced by the addition of Mg to a plating bath. However, the plating method based on this plating composition is meant for a small plating thickness on steel sheets and when the method is applied to heavy plating steel wires represented by steel wires for outdoor exposed uses such as structures, revetments, fishing nets, fences, etc., there occurs a problem that cracks develop in the plated layers during the working of the plated steel wires. Japanese Unexamined Patent Publication No. H7-207421 discloses a method to apply Zn—Al—Mg alloy plating of a heavy plating thickness. When this method is applied to the plating of steel wires without modification, however, a thick Fe—Zn alloy layer forms and there is a problem that the Fe—Zn alloy layer cracks or peels off during the working of the plated steel wires.

DISCLOSURE OF THE INVENTION

The object of the present invention is, in view of the above problems, to provide a hot dip zinc alloy plated steel material, particularly a hot dip zinc alloy plated steel wire, excellent in corrosion resistance and workability which does not suffer cracks and exfoliation in a plated layer and/or a plated alloy layer during the working of the plated steel wire, and a method to produce the plated steel wire.

The present inventors established the present invention as a result of studying the means to solve the above problems and the gist of the present invention is as follows:

(1) A plated steel material excellent in corrosion resistance and workability, characterized by having an alloy layer 20 μm or less in thickness consisting of, in mass, 25% or less of Fe, 30% or less of Al, 5% or less of Mg and the balance consisting of Zn, at the interface of a plated layer and a base steel.

(2) A plated steel material excellent in corrosion resistance and workability, characterized by having: an alloy layer 20 μor less in thickness consisting of, in mass, 25% or less of Fe, 30% or less of Al, 5% or less of Mg and the balance consisting of Zn at the interface of a plated layer and a base steel; and the plated layer consisting of, as an average composition in mass, 4 to 20% of Al, 0.8 to 5% of Mg, 2% or less of Fe and the balance consisting of Zn, on top of the alloy layer.

(3) A plated steel material excellent in corrosion resistance and workability, characterized by having, at the interface of a plated layer and a base steel, an alloy layer composed of: an inner alloy layer 5 μm or less in thickness consisting of, in mass, 15% or more of Fe, 20% or more of Al, 2% or more of Si, 5% or less of Mg and the balance consisting of Zn; and an outer alloy layer 30 μor less in thickness consisting of, in mass, 25% or less of Fe, 30% or less of Al, 2% or more of Si, 5% or less of Mg and the balance consisting of Zn.

(4) A plated steel material excellent in corrosion resistance and workability, characterized by having: at the interface of a plated layer and a base steel, an alloy layer composed of an inner alloy layer 5 μm or less in thickness consisting of, in mass, 15% or more of Fe, 20% or more of Al, 2% or more of Si, 5% or less of Mg and the balance consisting of Zn and an outer alloy layer 30 μm or less in thickness consisting of, in mass, 25% or less of Fe, 30% or less of Al, 2% or more of Si, 5% or less of Mg and the balance consisting of Zn; and, on top of the outer alloy layer, the plated layer consisting of, as an average composition in mass, 4 to 20% of Al, 0.8 to 5% of Mg, 0.01 to 2% of Si, 2% or less of Fe and the balance consisting of Zn, and containing $Mg_2Si$ dispersively existing therein.

(5) A plated steel material excellent in corrosion resistance and workability according to the item (2), characterized in that the solidification structure of the plated layer is a granular crystal structure or a columnar crystal structure.

(6) A plated steel material excellent in corrosion resistance and workability according to the item (2) or (4), characterized in that each of an a phase mainly composed of Al—Zn, a β phase consisting of Zn only or an Mg—Zn alloy layer and a Zn—Al—Mg ternary eutectic phase exist in the structure of the plated layer.

(7) A plated steel material excellent in corrosion resistance and workability according to the item (6), characterized in that the volume percentage of the β phase existing in the structure of the plated layer is 20% or less.

(8) A plated steel material excellent in corrosion resistance and workability according to the item (2) or (4), characterized in that the plated layer further contains one or more of the elements selected from among one or more of the groups of a, b, c and d below;

a: one or more elements of Ti, Li, Be, Na, K, Ca, Cu, La and Hf in 0.01 to 1.0 mass % each, b: one or more elements of Mo, W, Nb and Ta in 0.01 to 0.2 mass % each, c: one or more elements of Pb and Bi in 0.01 to 0.2 mass % each, d: one or more elements of Sr, V, Cr, Mn and Sn in 0.01 to 0.5 mass % each.

(9) A plated steel material excellent in corrosion resistance and workability according to any one of the items (1) to (8), characterized in that the plated steel material further has any one of a paint coating and a heavy anticorrosion coating.

(10) A plated steel material excellent in corrosion resistance and workability according to the item (9), characterized in that the heavy anticorrosion coating consists of one or more of the high molecular compounds selected from among vinyl chloride, polyethylene, polyurethane and fluororesin.

(11) A plated steel material excellent in corrosion resistance and workability according to any one of the items (1) to (10), characterized in that the plated steel material is a plated steel wire.

(12) A method to produce a plated steel material excellent in corrosion resistance and workability, characterized by: applying to a steel material a hot dip galvanizing containing, in mass, 3% or less of Al and 0.5% or less of Mg as the first step, and then a hot dip alloy plating consisting of, as an average composition in mass, 4 to 20% of Al, 0.8 to 5% of Mg, 2% or less of Fe and the balance consisting of Zn as the second step, so as to form an alloy layer 20 μm or less in thickness consisting of, in mass, 25% or less of Fe, 30% or less of Al, 5% or less of Mg and the balance consisting of Zn at the interface of a plated layer and a base steel; and then making the solidification structure of the plated layer a granular crystal structure by cooling the plated steel material at a cooling rate of 300° C./sec. or less or a columnar crystal structure by cooling the plated steel material at a cooling rate of 300° C./sec. or more.

(13) A method to produce a plated steel material excellent in corrosion resistance and workability, characterized by: applying to a steel material hot dip galvanizing containing, in mass, 3% or less of Al and 0.5% or less of Mg as the first step, and then a hot dip alloy plating consisting of, as an average composition in mass, 4 to 20% of Al, 0.8 to 5% of Mg, 0.01 to 2% of Si, 2% or less of Fe and the balance consisting of Zn as the second step, so as to form an alloy layer composed of an inner alloy layer 5 μm or less in thickness consisting of, in mass, 15% or more of Fe, 20% or more of Al, 2% or more of Si, 5% or less of Mg and the balance consisting of Zn and an outer alloy layer 30 μm or less in thickness consisting of, in mass, 25% or less of Fe, 30% or less of Al, 2% or more of Si, 5% or less of Mg and the balance consisting of Zn at the interface of a plated layer and a base steel; and then making the solidification structure of the plated layer a granular crystal structure by cooling the plated steel material at a cooling rate of 300° C./sec. or less or a columnar crystal structure by cooling the plated steel material at a cooling rate of 300° C./sec. or more.

(14) A method to produce a plated steel material excellent in corrosion resistance and workability according to the item (12) or (13), characterized in that the hot dip alloy plating of the second step further contains one or more of the elements selected from among one or more of the groups of a, b, c and d below;

a: one or more elements of Ti, Li, Be, Na, K, Ca, Cu, La and Hf in 0.01 to 1.0 mass % each, b: one or more elements of Mo, W, Nb and Ta in 0.01 to 0.2 mass % each, c: one or more elements of Pb and Bi in 0.01 to 0.2 mass % each, d: one or more elements of Sr, V, Cr, Mn and Sn in 0.01 to 0.5 mass % each.

(15) A method to produce a plated steel material excellent in corrosion resistance and workability according to the item (12) or (13), characterized by: conducting the first step hot dip galvanizing at an immersion time of 20 sec. or less in a plating bath and then the second step hot dip zinc alloy plating at an immersion time of 20 sec. or less in another plating bath; and, at both the first and second steps of the plating, purging the areas where the steel material is pulled up out of the plating bathes with nitrogen gas in order to prevent the plating bath surface and the plated steel material from oxidizing.

(16) A method to produce a plated steel material excellent in corrosion resistance and workability according to the item (12) or (13), characterized by solidifying the plated alloy by direct cooling using any one of the cooling means of water spray, gas-atomized water spray or water flow immediately after the plated steel material is pulled up from the plating bath of the second step hot dip zinc alloy plating.

(17) A method to produce a plated steel material excellent in corrosion resistance and workability according to the item (12) or (13), characterized by commencing the cooling of the plated steel material at a temperature 20° C. or less above the melting point of the plating alloy.

(18) A method to produce a plated steel material excellent in corrosion resistance and workability according to any one of the items (12) to (17), characterized in that the plated steel material is a plated steel wire.

BRIEF DESCRIPTION OF THE DRAWINGS

FIGS. 3 (*b*) and (*c*) are photomicrographs showing the plating structures of plated steel wires having granular crystal structures. FIG. 3 (*d*) is a photomicrograph showing the plated layer of a granular crystal structure having an inner alloy layer and an outer alloy layer as shown in FIG. 1 (*b*).

BEST MODE FOR CARRYING OUT THE INVENTION

Figure 1A:
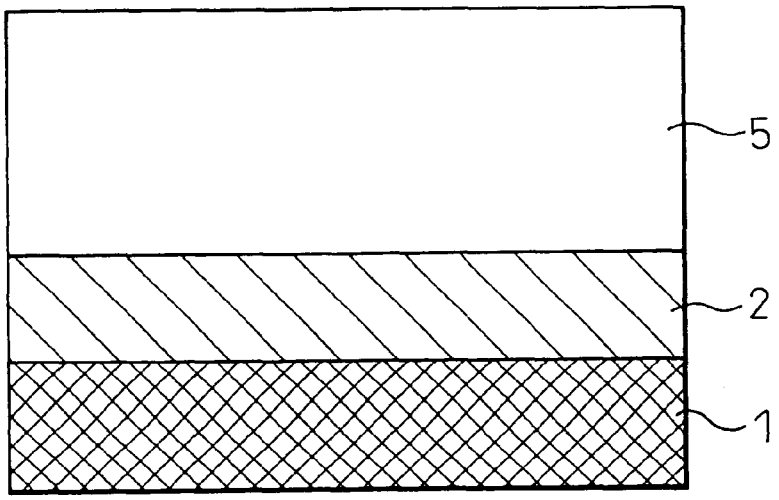
FIG. 1 (*a*) is a view showing the plating structure formed by Fe—Zn—Al—Mg alloy plating according to the present invention, and FIG. 1 (*b*) is a view showing the plating structure formed by Fe—Zn—Al—Mg—Si alloy plating according to the present invention.

A plated steel wire according to the present invention has: a plated layer consisting of, as an average composition in mass, 4 to 20% of Al, 0.8 to 5% of Mg, 2% or less of Fe and the balance consisting of Zn; and, at the interface of the plated layer and a base steel, an alloy layer 20 μm or less in thickness consisting of, in mass, 25% or less of Fe, 30% or less of Al, 5% or less of Mg and the balance consisting of Zn. Further, a plated steel wire according to the present invention has, at the interface of a plated layer and a base steel, an alloy layer 20 μm or less in thickness consisting of, in mass, 25% or less of Fe, 30% or less of Al, 5% or less of Mg and the balance consisting of Zn. Furthermore, the plated layer consists of, as an average composition in mass, 4 to 20% of Al, 0.8 to 5% of Mg, 2% or less of Fe, in addition, one or more of the elements to enhance corrosion resistance, improve the hardness and workability of the plated layer and fine the plating structure, and the balance consisting of Zn.

A plated steel wire according to the present invention has: a plated layer consisting of, as an average composition in mass, 4 to 20% of Al, 0.8 to 5% of Mg, 0.01 to 2% of Si, 2% or less of Fe, in addition, one or more of the elements to enhance corrosion resistance, improve the hardness and workability of the plated layer and fine the plating structure, and the balance consisting of Zn, and containing $Mg_2Si$ dispersively existing therein; and, at the interface of the plated layer and a base steel, an alloy layer composed of an inner alloy layer 5 μm or less in thickness consisting of, in mass, 15% or more of Fe, 20% or more of Al, 2% or more of Si, 5% or less of Mg and the balance consisting of Zn and an outer alloy layer 30 μm or less in thickness consisting of, in mass, 20% or less of Fe, 30% or less of Al, 2% or more of Si, 5% or less of Mg and the balance consisting of Zn.

In the first place, the roles and the contents of the alloying elements contained in a plated layer and an alloy layer formed at the interface of the plated layer and a base steel will be explained hereafter.

An alloy layer mainly consisting of Fe—Zn forms at the interface of a plated layer and a base steel. This Fe—Zn alloy layer is, more precisely, structured with an alloy layer consisting of, in mass, 25% or less of Fe, 30% or less of Al, 5% or less of Mg and the balance consisting of Zn and its thickness is 20 μm or less. In a plated steel wire according to the present invention, an Fe—Zn—Al—Mg—Si alloy layer forms at the interface of a plated layer and a base steel, and this alloy layer is composed of an inner alloy layer (reference numeral 2 in the figure) 5 μm or less in thickness consisting of, in mass, 15% or more of Fe, 20% or more of Al, 2% or more of Si, 5% or less of Mg and the balance consisting of Zn and an outer alloy layer (reference numeral 3 in the figure) 30 μm or less in thickness consisting of, in mass, 25% or less of Fe, 30% or less of Al, 2% or more of Si, 5% or less of Mg and the balance consisting of Zn.

The Fe—Zn—Al—Mg alloy layer will be explained first.

Figure 1B:
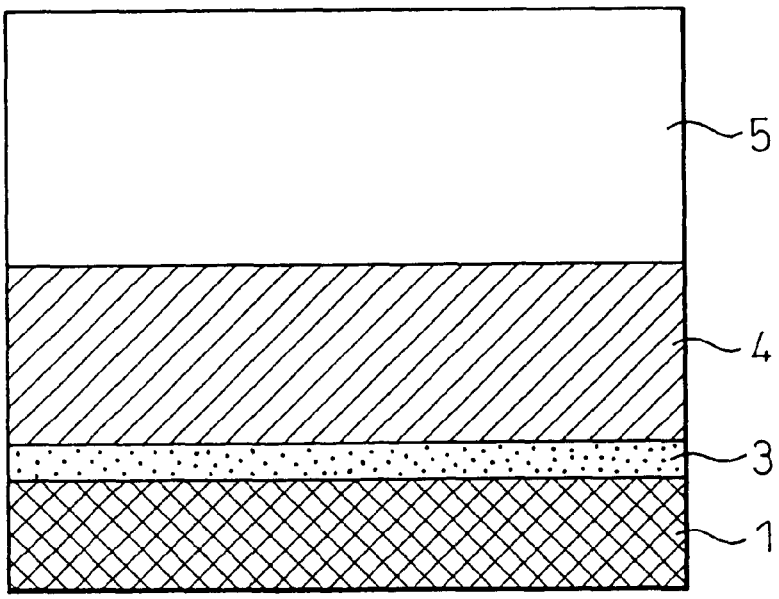

As shown in FIG. 1 (*a*), an Fe—Zn alloy layer 2 is formed at the interface of a plated layer 5 and a base steel 1. The Fe—Zn alloy layer plays a role to bind the plating to the base steel. Namely, the alloy layer binds the plating and, when the base steel undergoes an elastic or plastic deformation, prevents the plating from peeling off by absorbing the difference in deformation coefficient caused by the difference in the modulus of elasticity or deformation resistance between the plated alloy and the base steel. The Fe—Zn alloy, however, is brittle and, when its Fe content exceeds 25%, the alloy layer cracks during working, causing the plating to peel off. For this reason, the upper limit of Fe content is set at 25%. A more preferable Fe content is 2 to 25%. The existence of Al in this alloy layer gives ductility to the alloy layer. However, when its content exceeds 30%, a hardened phase appears and workability is deteriorated. For this reason, the upper limit of the Al content is set at 30%. A more preferable Al content is 2 to 30%. Mg enhances corrosion resistance of the alloy layer, but it makes the alloy layer brittle at the same time. Since the upper limit of the Mg content not causing embrittlement is 5%, this figure is defined as its upper limit. A more preferable Mg content is 0.5 to 5%.

When the alloy layer is thick, cracks easily develop in the alloy layer, the interface of the alloy layer and the base steel or the interface of the alloy layer and the plated layer. When the alloy layer thickness exceeds 20 μm, the cracks occur so frequently that the plating cannot stand practical use. Since the alloy layer is inferior in corrosion resistance to the plated layer by nature, the thinner it is, the better. A desirable thickness is 10 μm or less, more preferably, 3 μm or less. Because the upper limit of the Fe—Zn alloy layer not deteriorating the workability is 20 μm, for the reasons described above, the thickness of the alloy layer has to be 20 μm or less.

Next, the outer and inner layers of an alloy layer will be explained hereafter with regard to the case that the alloy layer contains Si according to the present invention.

The present inventors have discovered that, when an alloy layer contains Si, as shown in FIG. 1 (*b*), there exists, at the interface of a plated layer 5 and a base steel 1, a thin layer (an inner alloy layer, reference numeral 3 in FIG. 1 (*b*)) 5 μm or so in thickness having a different composition and a different structure from those of the alloy layer, and that the corrosion resistance of a steel wire having the thin layer is much better than that of a steel wire not having it.

The reason why corrosion resistance is largely enhanced by the existence of the inner alloy layer has not yet been made clear, but it is suspected that the thin layer blocks the propagation of corrosion.

The thickness of the inner alloy layer is 5 μm or less. When it exceeds 5 μm, the adhesion of the outer alloy layer to the base steel is adversely affected and the workability of the plated steel wire is deteriorated. To obtain desired corrosion resistance, however, it is preferable that the thickness of the inner alloy layer is 0.05 μm or more.

The content of Mg in the inner alloy layer is defined to be 5% or less, as is the Mg content in the plated layer. When the content of Fe, Al or Si in the inner alloy layer is below 15%, 20% or 2%, respectively, then the content of any one of these elements has to be increased. But this causes phase separation and renders the alloy layer unstable and, consequently, a desired corrosion resistance cannot be obtained. For this reason, it is necessary for the inner alloy layer to contain 15% or more of Fe, 20% or more of Al and 2% or more of Si.

Hereafter explained will be the outer alloy layer (reference numeral 4 in FIG. 1 (*b*)) 30 μm or less in thickness consisting of, in mass, 25% or less of Fe, 30% or less of Al, 2% or more of Si, 5% or less of Mg and the balance consisting of Zn, formed on the outer surface of the inner alloy layer.

The outer alloy layer is a mixture of several alloy structures, and it is brittle. When the Fe content exceeds 25%, the outer alloy layer cracks during working, causing the plating to peel off. Hence, its upper limit is set at 25%. A more preferable Fe content is 2 to 20%. The existence of Al in the outer alloy layer gives ductility to the outer alloy layer. However, when its content exceeds 30%, a hardened phase appears and workability is deteriorated. For this reason, the upper limit of the Al content is set at 30%. A more preferable Al content is 2 to 25%.

When the Si content in the outer alloy layer is below 2%, desired corrosion resistance cannot be obtained and, therefore, its content has to be 2% or more. With an excessive Si content, the outer alloy layer tends to become hard and brittle, and thus it is preferable that the Si content is 15% or so or less.

Mg enhances corrosion resistance of the alloy layer, but it makes the alloy layer brittle at the same time. For this reason, the upper limit of the Mg content is set at 5%, the maximum amount not causing embrittlement. A more preferable Mg content is 0.5 to 5%.

When the outer alloy layer is thick, cracks easily develop in the alloy layer, the interface of the alloy layer and the base steel or the interface of the alloy layer and the plated layer.

Figure 2:
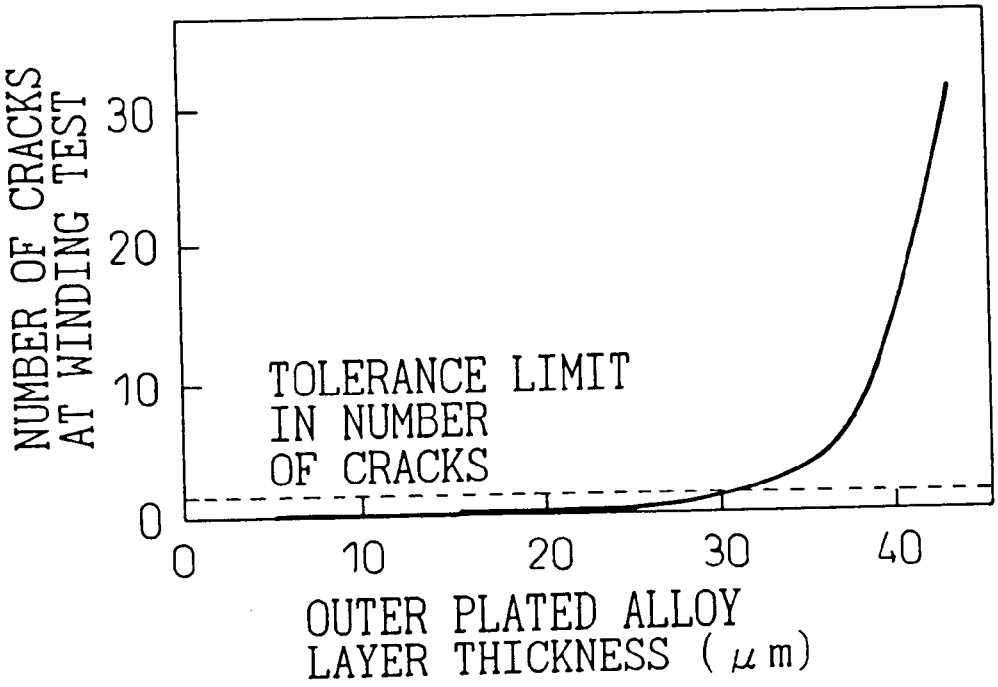
FIG. 2 is a graph showing the relationship between the thickness of an outer alloy plated layer formed by Fe—Zn—Al—Mg—Si alloy plating according to the present invention and the number of cracks in a winding test.
Figure 3A:
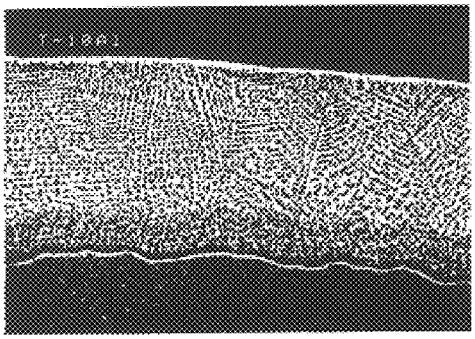
FIG. 3 (*a*) is a photomicrograph showing the plating structure of a plated steel wire having a columnar crystal structure.
Figure 3B:
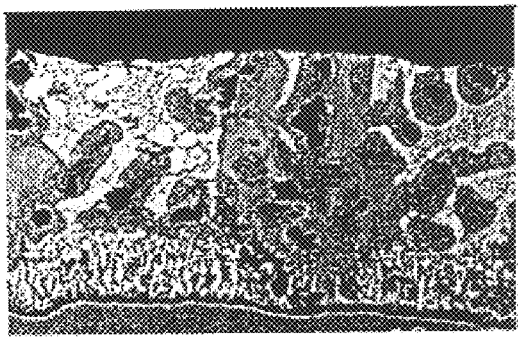
Figure 3C:
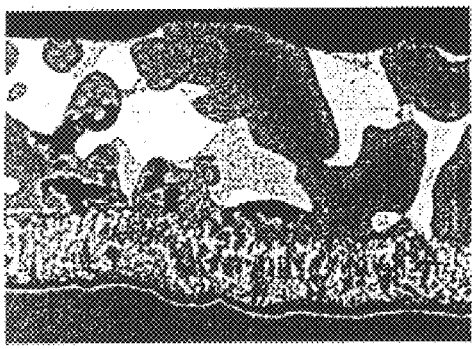
Figure 3D:
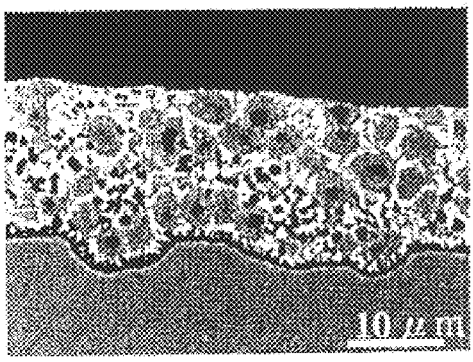

FIG. 2 is a graph showing the plating adhesiveness of the outer alloy layer in the case of Zn-11% Al-1Mg-0.1% Si alloy plating, using the relationship between the thickness of the outer alloy layer and the number of cracks in a winding test. As seen in the figure, when the thickness of the outer alloy layer exceeds 30 $\mu$m, the cracks occur so conspicuously that the plating cannot stand practical use.

Since the outer alloy layer is inferior in corrosion resistance to the plating layer by nature, the thinner it is the better. A desirable thickness is 15 $\mu$m or less, more preferably, 5 $\mu$m or less. From an ideal viewpoint, it is desirable that the outer alloy layer does not exist.

Because the upper limit thickness of the outer alloy layer which does not deteriorate workability is 30 $\mu$m for the reasons described above, the thickness of the Fe—Al—Si—Zn Si—Zn outer alloy layer has to be 30 $\mu$m or less.

The roles and the contents of the alloying elements contained in the plated layer will be explained next.

Al increases corrosion resistance and prevents the other elements in the plated layer from oxidizing. With an Al addition below 4%, however, an effect to prevent the oxidation of Mg in a plating bath cannot be obtained. When Al is added in excess of 20%, the resultant plated layer becomes so hard and brittle that it cannot withstand working. For this reason, the range of Al addition amount in the plated layer has to be from 4 to 20%. A desirable range of the Al addition amount for heavy plating of a steel wire is from 9 to 14%. A stable plated layer is obtained with an Al content in this range.

Mg enhances the corrosion resistance of the plating alloy since Mg forms evenly distributed corrosion products of the plating and the corrosion products containing Mg block the propagation of corrosion. With an addition below 0.8%, however, the effect to enhance corrosion resistance cannot be obtained and, when added in excess of 5%, oxides easily form on a plating bath surface, causing the formation of dross in quantities and making plating operation difficult. Thus, for obtaining good corrosion resistance and suppressing the dross formation at the same time, the range of the Mg addition amount has to be from 0.8 to 5%.

Fe is included in the plated layer through the melting of the steel material during plating operation or as an impurity in a plating metal. When its content exceeds 2%, corrosion resistance is deteriorated, and thus its upper limit is set at 2%. No lower limit is set specifically regarding the Fe content, and the absence of Fe is acceptable in some cases.

Si is added to form $Mg_2Si$ in the plated layer and to enhance the corrosion resistance further. The grain size of $Mg_2Si$ is 0.1 to 20 $\mu$m or so and it disperses evenly in the plated layer in fine grains to enhance the corrosion resistance. With an addition below 0.01%, an amount of $Mg_2Si$ sufficient for the enhancement of corrosion resistance does not form and a desired effect of corrosion resistance improvement is not obtained. The larger the content of Al, the better Si works. When the Al content is 20%, i.e. its upper limit value, the maximum addition amount of Si is 2%. The range of the Si content is, therefore, defined to be from 0.01 to 2%.

In addition to the Al, Mg and Fe described above, the plated layer according to the present invention may contain one or more of the elements selected from among each of the groups of a, b, c and d below;

a: one or more elements of Ti, Li, Be, Na, K, Ca, Cu, La and Hf in 0.01 to 1.0 mass % each, b: one or more elements of Mo, W, Nb and Ta in 0.01 to 0.2 mass % each, c: one or more elements of Pb and Bi in 0.01 to 0.2 mass % each, d: one or more elements of Sr, V, Cr, Mn and Sn in 0.01 to 0.5 mass % each.

Ti enhances corrosion resistance, and so does any of Li, Be, Na, K, Ca, Cu, La and Hf. Corrosion resistance is improved by adding 0.01 to 0.5 mass % each of one or more of these elements. With an addition below 0.01%, a tangible effect is not obtained. When added in excess of 1.0%, phase separation may take place during the solidification of the plating. Thus, the content of each of these elements is defined to be from 0.01 to 0.5%.

Mo raises the hardness of the plated layer and makes it resistant against scratches, and so does any of W, Nb and Ta. The hardness of the plated layer is increased and it is rendered resistant against scratches when one or more of these elements are added by 0.01 to 0.2 mass % each.

Either Pb or Bi makes the crystal grain size at the plated layer surface fine. On a large plated surface of a steel sheet or a section, crystals of a plating alloy sometimes grow large to form a pattern. When either Pb or Bi, which is insoluble to Zn and Fe, is added to prevent this from taking place, it acts as nuclei for the solidification of the plating, promoting fine crystal growth, and the pattern does not form. The range from 0.01 to 0.2 mass % is the one where the above effect is obtained.

Any of Sr, V, Cr, Mn and Sn enhances workability. With an addition below 0.01%, a tangible effect is not obtained. When added in excess of 0.5%, segregation becomes conspicuous and cracks are likely to develop during the working of the plated steel material. Therefore, the content of these elements has to be 0.01 to 0.5% each.

An alloy layer mainly consisting of Fe—Zn is formed at the interface of the plated layer and the base steel. The structure of this Fe—Zn alloy layer is, to be precise, composed of the alloy layer consisting of, in mass, 25% or less of Fe, 30% or less of Al, 5% or less of Mg and the balance consisting of Zn, and having the thickness of 20 $\mu$m or less. The Fe—Zn alloy layer is brittle and, when the Fe content exceeds 25%, the alloy layer cracks during working, causing the plating to peel off. For this reason, its upper limit is set at 25%. A more preferable Fe content is 2 to 25%. The existence of Al in the alloy layer gives ductility to the alloy layer. But, when its content exceeds 30%, a hardened phase appears and workability is deteriorated. Therefore, the upper limit of the Al content is set at 30%. A more preferable Al content is 2 to 30%. Mg enhances corrosion resistance of the alloy layer, but it makes the alloy layer brittle at the same time. Since the upper limit of the Mg content not causing embrittlement is 5%, this figure is defined as its upper limit. A more preferable Mg content is 0.5 to 5%.

Further, in a plated steel material according to the present invention, the plated layer mainly comprises Al and Mg and, therefore, by the cooling after the plating process, it is possible to have an a phase mainly composed of Al—Zn, a β phase consisting of Zn only or an Mg—Zn alloy layer and a Zn/Al/Zn—Mg ternary eutectic phase coexist in the plated alloy layer (the plated layer) immediately outside the alloy layer existing at the interface of the plating and the base steel. Among these, the presence of the Zn/Al/Zn—Mg ternary eutectic phase causes the corrosion products to form evenly and prevents the corrosion caused by the corrosion products from propagating. The β phase has poorer corrosion resistance than the other phases and, hence, is likely to cause local corrosion. When its volume percentage exceeds 20%, corrosion resistance is deteriorated and, therefore, its volume percentage has to be 20% or less.

According to the present invention, a steel material is cooled after the plating process. This cooling may either be a slow cooling or a rapid cooling. If cooled slowly, the solidification structure of the plating becomes a granular crystal structure and, if cooled rapidly, the solidification structure becomes a columnar crystal structure. If what is required is a plated steel material having both corrosion resistance and workability, it is preferable that the solidification structure is the granular crystal structure but, if high corrosion resistance only is required while risking workability to some extent, then the columnar crystal structure may be accepted. It is preferable that the rate of the cooling is within the range of 100 to 400° C./sec.

The purpose of making the solidification structure of a plated layer a granular crystal structure is to provide the plated steel material with both corrosion resistance and workability. The solidification structure of a plated layer is made a granular crystal structure by conducting hot dip galvanizing and then hot dip zinc alloy plating and, thereafter, cooling at a cooling rate of 300° C./sec. or lower.

The purpose of making the solidification structure of a plated layer a columnar crystal structure is, on the other hand, to provide the plated steel material with corrosion resistance. The solidification structure of a plated layer is made a columnar crystal structure by conducting hot dip galvanizing and then hot dip zinc alloy plating and, thereafter, cooling at a cooling rate of 300° C./sec. or higher.

FIG. 3 shows the schematic views of the structures of the plated layers. In the figure, the cooling rate is 350° C./sec. in (a), and 150° C./sec. in (b) and (c). The solidification structure of the plated layer obtained by the method of the present invention shown in FIG. 3 (*a*) is the columnar crystal solidification structure. A fine granular crystal structure is seen between dendritic structures which grew during solidification. Since the structure is fine and the structure having poor corrosion resistance is not continuous, corrosion does not propagate easily from the surface layer, resulting in high corrosion resistance. The solidification structures of the plated layers obtained by the method of the present invention shown in FIGS. 3 (*b*) and (*c*) are the complete granular crystal structures. In case of a plated steel wire, cracks do not occur since a soft granular structure is stretched between the hard columnar structures when an intensive working such as a drawing at an area reduction ratio exceeding 60% is applied.

FIG. 3 (*d*) shows an example of the case that the alloy layer contains Si and the cooling rate is 150° C./sec. Here, both the inner and outer alloy layers have columnar crystal structures.

The method to produce a plated steel material according to the present invention employs a two-step plating method. A plated steel material according to the present invention can be obtained efficiently by applying hot dip galvanizing with zinc as the main component to form an Fe—Zn alloy layer in the first step and then hot dip zinc alloy plating with the average composition specified in the present invention in the second step. With regard to the zinc used in the first step hot dip galvanizing, any one of the following can be used as the plating bath material: pure zinc; a zinc-dominant alloy containing very small amounts of mish metal, Si, Pb, etc. added to zinc for the purpose of preventing the oxidation of the plating bath and improving its fluidity; and a zinc alloy containing, in mass, 3% or less of Al and 0.5% or less of Mg added for the purpose of promoting the growth of the plated alloy layer. If Al and Mg are included in the Fe—Zn alloy layer at the time of forming an Fe—Zn alloy layer in the first step hot dip galvanizing, the Al and Mg easily permeate in the plated alloy.

In the method to produce a plated steel material according to the present invention, the workability of the plated steel material may be improved by purging the area where the steel material is pulled up out of the plating bath with nitrogen gas and preventing a plating bath surface and a plated steel material from oxidizing. If an oxide forms on the plating surface immediately after the plating process or an oxide formed on the plating bath surface attaches to the plating surface, the oxide may trigger cracking in the plating during working of the plated steel material. For this reason, preventing the plating bath exit area from oxidizing is important. Argon, helium or other inert gas can be used for the prevention of the oxidation besides nitrogen, but nitrogen is the best from the cost viewpoint.

Figure 4:
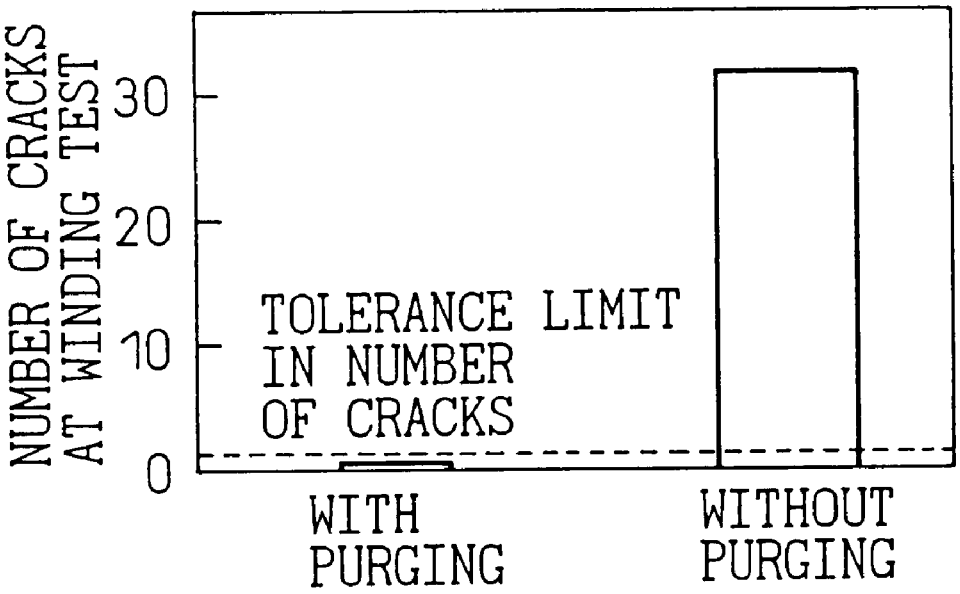
FIG. 4 is a graph showing the number of surface cracks on Fe—Zn—Al—Mg—(Si) alloy plated steel wires in a winding test comparing the case of air-purging with that of no air-purging.

FIG. 4 is a graph showing the number of surface cracks in a winding test of the plated steel wires having the plating alloy compositions (Zn-10% Al-5Mg, Zn-10% Al-3Mg-0.1Si) according to the present invention, comparing the case of air-purging with that of no air-purging. A number of surface cracks larger than tolerable limit occur in the plated steel wires without air-purging.

When producing a plated steel material by a two-step plating method according to the present invention, it is necessary for an appropriate growth of the plated alloy to conduct the first step hot dip galvanizing mainly containing zinc at a bath immersion time of 20 sec. or less, and then the second step hot dip zinc alloy plating at a bath immersion time of 20 sec. or less. When the immersion time is longer than the above, the thickness of the alloy layer exceeds 20 μm and, for this reason, the first step hot dip plating mainly containing zinc has to be conducted at a bath immersion time of 20 sec. or less and, then, the second step hot dip zinc alloy plating at a bath immersion time of 20 sec. or less.

Even if the alloy layer grows at the first step plating of a bath immersion time of 20 sec. or less, its thickness does not grow much at the second step hot dip zinc alloy plating, as long as the immersion time in the alloy bath is 20 sec. or less. Thus, the alloy layer thickness does not exceed 20 μm.

In the present invention, as a concrete means to cool a plated steel material after a plating process, a direct cooling method to solidify the plated alloy is employed, wherein a purging cylinder equipped with any one of the cooling means of water spray, gas-atomized water spray or water flow is used and the plated steel wire is made to pass through the purging cylinder immediately after being pulled up from the plating bath of the second step hot dip zinc alloy plating. It is preferable to commence the cooling at a temperature of 20° C. above the melting point of the plating alloy and cool with a water spray or a gas-atomized water spray to obtain a stable plated layer. FIG. 4 shows the difference in the number of cracks in a winding test of plated steel wires or rods in the case of air-purging in the purging cylinder and in that of no air-purging. Steel wires were plated using plating baths of identical compositions and under the same conditions except for using the purging cylinder or not, and the numbers of surface cracks in a winding test of the plated steel wires were compared. It is clear in the figure that the purging cylinder has a significant effect.

The present invention can be applied to any low carbon steel materials. A preferable chemical composition of the steel material used in the present invention is, typically, in mass, 0.02 to 0.25% of C, 1% or less of Si, 0.6% or less of Mn, 0.04% or less of P, 0.04% or less of S and the balance consisting of Fe and unavoidable impurities.

In the present invention, the corrosion resistance of a plated steel wire may be further and finally enhanced by applying a paint coating or a heavy anticorrosion coating consisting of one or more of the high molecular compounds selected from among vinyl chloride, polyethylene, polyurethane and fluororesin.

The present invention has been explained by focusing mainly on a plated steel material, a plated steel wire in particular. However, it is, of course, also satisfactorily applicable to steel sheets and plates, steel pipes, steel structures and other steel products.

EXAMPLE

Example 1

JIS G 3505 SWRM6 steel wires 4 mm in diameter plated with pure zinc were plated additionally with a Zn—Al—Mg zinc alloy under the conditions shown in Table 1, and their characteristics were evaluated. As comparative samples, the same steel wires were plated using different plating compositions and Fe—Zn alloy layers, and their characteristics were evaluated likewise. The purging cylinder was used for all the steel wires and its interior was purged with nitrogen gas. The structure of the plating was observed with an EPMA at a polished C section surface of the plated steel wires. A 2-$\mu$m diameter beam was used for the quantitative analysis of the alloy layer composition. Corrosion resistance was evaluated in a 250-hr. continuous salt spray test, wherein corrosion weight loss per unit area of the plating was calculated from the difference between the weights before and after the test. A sample showing a corrosion weight loss of 20 g/m$^2$ or less was evaluated as good (marked with O in the table, otherwise it was marked with x).

Workability was evaluated by winding the sample plated wires around a 6-mm diameter steel rod in 6 rounds and visually inspecting the occurrence or otherwise of cracks on the plated surface. Exfoliation of the plating was visually observed by applying an adhesive tape onto the surface of a sample wire after the cracking evaluation and peeling it off. A sample showing 1 crack or none and no exfoliation of the plating was evaluated as good (marked with O in the table, otherwise it was marked with x).

Table 1 shows the relationship of the plating composition, the composition and thickness of the alloy layer, the plating structure and the volume percentage of the β phase with corrosion resistance, workability and dross formation in the plating bath. Any of the samples according to the present invention showed good corrosion resistance and workability, and also small dross formation.

In comparative samples 1 to 5, the composition of the plating alloy did not conform to that stipulated in the present invention: in comparative samples 1 and 2, the content of Al or Mg was lower than the relevant lower limit according to the present invention and, consequently, corrosion resistance was poor; in comparative samples 3 to 5, the content of Al or Mg was higher than the relevant upper limit according to the present invention and, consequently, corrosion resistance was poor. In comparative samples 6 and 7, the thickness of the plated alloy layer was outside the range specified in the present invention, and workability was poor. In comparative samples 8 to 10, the volume percentage of the β phase in the plating structure was outside the range specified in the present invention, and corrosion resistance was poor.

TABLE 1

| | Average Plating composition | | | Alloy Layer | | | | Plated Layer | | | | | | | Dross formation in plating bath |
|---|---|---|---|---|---|---|---|---|---|---|---|---|---|---|---|
| | Al % | Mg % | Fe % | Al % | Mg % | Fe % | Thickness μm | Thickness μα | Cooled structure | Structure | Volume percentage of β phase % | Corrosion weight loss g/m$^2$ | Winding test Crack | Winding test Exfoliation | |
| Inventive sample | | | | | | | | | | | | | | | |
| 1 | 4 | 2.8 | 0.92 | 21 | 3.6 | 15.3 | 4.6 | 13.5 | Granular crystal | α/β/Ternary eutectic | 10 | 19 | o | o | o |
| 2 | 20 | 1.5 | 0.08 | 26 | 1.7 | 23.2 | 1.4 | 16.5 | Granular crystal | α/β/Ternary eutectic | 17 | 15 | o | o | o |
| 3 | 6 | 0.9 | 0.69 | 23 | 1.3 | 27.8 | 4.9 | 25.2 | Granular crystal | α/β/Ternary eutectic | 15 | 10 | o | o | o |
| 4 | 8 | 4.8 | 0.88 | 21 | 4.5 | 25.7 | 2.4 | 13.3 | Granular crystal | α/β/Ternary eutectic | 19 | 13 | o | o | o |
| 5 | 17 | 0.9 | 0.02 | 25 | 1.5 | 25.6 | 0.9 | 29.1 | Columnar crystal | α/β/Ternary eutectic | 16 | 14 | o | o | o |

TABLE 1-continued

| | Average Plating composition | | | Alloy Layer | | | | Plated Layer | | | Volume | Corrosion | Winding test | | Dross |
|---|---|---|---|---|---|---|---|---|---|---|---|---|---|---|---|
| | Al % | Mg % | Fe % | Al % | Mg % | Fe % | Thickness μm | Thickness μα | Cooled structure | Structure | percentage of β phase % | weight loss g/m² | Crack | Exfoliation | formation in plating bath |
| 6 | 19 | 3 | 1.99 | 27 | 3.6 | 21.8 | 2.6 | 25.6 | Columnar crystal | α/β/Ternary eutectic | 13 | 8 | o | o | o |
| 7 | 10 | 1.1 | 0.55 | 21 | 3.7 | 24.2 | 0.03 | 25.6 | Columnar crystal | α/β/Ternary eutectic | 12 | 14 | o | o | o |
| 8 | 12 | 1.3 | 1.36 | 23 | 1.6 | 27.6 | 1.8 | 43.3 | Columnar crystal | α/β/Ternary eutectic | 14 | 8 | o | o | o |
| 9 | 11 | 1.1 | 0.6 | 24 | 1.8 | 20.1 | 3.5 | 30.4 | Granular crystal | α/β/Ternary eutectic | 13 | 7 | o | o | o |
| Comparative sample | | | | | | | | | | | | | | | |
| 1 | 2 | 1.1 | 0.8 | 15.3 | 0.5 | 18.6 | 2.1 | 20 | Granular crystal | α/β/Ternary eutectic | 7 | x45 | o | o | o |
| 2 | 5 | 0.3 | 0.6 | 34.1 | 1.6 | 19.2 | 2.8 | 10 | Granular crystal | α/β/Ternary eutectic | 15 | x27 | o | o | o |
| 3 | 25 | 3.1 | 0.8 | 25.1 | 3.3 | 15.6 | 2.8 | 2.3 | Granular crystal | α/β/Ternary eutectic | 7 | x48 | o | o | o |
| 4 | 12 | 6.0 | 1.4 | 36.5 | 1.6 | 16.2 | 0.9 | 42 | Columnar crystal | α/β/Ternary eutectic | 16 | x30 | o | o | x |
| 5 | 18 | 6.0 | 1.9 | 20.3 | 5.6 | 16.7 | 2.7 | 10 | Columnar crystal | α/β/Ternary eutectic | 7 | x35 | o | o | o |
| 6 | 11 | 0.9 | 0.8 | 30.8 | 1.2 | 16.7 | x7 | 15 | Columnar crystal | α/β/Ternary eutectic | 12 | 14 | x | x | o |
| 7 | 10 | 2.3 | 5.0 | 29 | 3.1 | 21.4 | 4.9 | 60 | Granular crystal | α/β/Ternary eutectic | 9 | 13 | x | x | o |
| 8 | 8 | 0.9 | 1.5 | 30.6 | 1.1 | 18.4 | 3.4 | 8 | Granular crystal | α/β/Ternary eutecticx23 | | x46 | o | o | o |
| 9 | 13 | 2.1 | 0.8 | 33.4 | 2.8 | 15.5 | 3.1 | 10 | Columnar crystal | α/β/Ternary eutecticx26 | | x62 | o | o | o |
| 10 | 10 | 3.2 | 0.4 | 29.6 | 3.4 | 14.1 | 1.7 | 20 | Columnar crystal | α/β/Ternary eutecticx35 | | x38 | o | o | o |

Corrosion weight loss: Good when 20 g/m² or less.

Example 2

JIS G 3505 SWRM6 steel wires 4 mm in diameter plated with pure zinc were plated additionally with a Zn—Al—Mg zinc alloy under the conditions shown in Table 2, and their characteristics were evaluated. As comparative samples, the same steel wires were plated using different plating compositions and Fe—Zn alloy layers, and their characteristics were evaluated likewise. The purging cylinder was used for all the steel wires and its interior was purged with nitrogen gas. The structure of the plating was observed with an EPMA at a polished C section surface of the plated steel wires. A 2-μm diameter beam was used for the quantitative analysis of the alloy layer composition. Corrosion resistance was evaluated in a 250-hr. continuous salt spray test, wherein corrosion weight loss per unit area of the plating was calculated from the difference between the weights before and after the test. A sample showing a corrosion weight loss of 20 g/m² or less was evaluated as good (marked with O in the table, otherwise it was marked with x).

Workability was evaluated by winding the sample plated wires around a 6-mm diameter steel rod in 6 rounds and visually inspecting the occurrence or otherwise of cracks on the plating surface. Exfoliation of the plating was visually observed by applying an adhesive tape onto the surface of a sample wire after the cracking evaluation and peeling it off. A sample showing 1 crack or none and no exfoliation of the plating was evaluated as good (marked with O in the table, otherwise it was marked with x).

Table 2 shows the relationship of the plating composition, the composition and thickness of the alloy layer, the plating structure and the volume percentage of the β phase with corrosion resistance, workability and dross formation in the plating bath. Any of the samples according to the present invention showed good corrosion resistance and workability and also small dross formation.

In comparative samples 11 to 15, the composition of the plating alloy did not conform to that stipulated in the present invention: in comparative samples 11 and 12, the content of Al or Mg was lower than the relevant lower limit according to the present invention and, consequently, corrosion resistance was poor; in comparative samples 13 to 15 the content of Al or Mg was higher than the relevant upper limit according to the present invention and, consequently, corrosion resistance was poor. In comparative samples 16 and 17, the thickness of the plated alloy layer was outside the range specified in the present invention, and workability was poor. In comparative samples 18 to 20, the volume percentage of the β phase in the plating structure was outside the range specified in the present invention, and corrosion resistance was poor.

TABLE 2

| | Average plating composition | | | | | | | | | | | Alloy Layer | | | |
|---|---|---|---|---|---|---|---|---|---|---|---|---|---|---|---|
| | Al % | Mg % | Fe % | Ti % | Cu % | Na % | W % | Pb % | Cr % | Mn % | Sn % | Al % | Mg % | Fe % | Thickness μm |
| Inventive sample | | | | | | | | | | | | | | | |
| 10 | 4 | 2.8 | 0.92 | 0.3 | | | | | | 0.2 | | 21 | 3.6 | 15.3 | 4.6 |
| 11 | 20 | 1.5 | 0.08 | | 0.4 | | 0.05 | | 0.2 | | | 26 | 1.7 | 23.2 | 1.4 |
| 12 | 6 | 0.9 | 0.69 | | | 0.6 | | 0.1 | | | 0.6 | 23 | 1.3 | 27.8 | 4.9 |
| 13 | 8 | 4.8 | 0.88 | 0.8 | | | | | | | | 21 | 4.5 | 25.7 | 2.4 |
| 14 | 17 | 0.9 | 0.02 | | 0.9 | | 0.1 | | | | | 25 | 1.5 | 25.6 | 0.9 |
| 15 | 19 | 3 | 1.99 | 0.2 | | | | | | 0.3 | | 27 | 3.6 | 21.8 | 2.6 |
| 16 | 10 | 1.1 | 0.55 | | 0.3 | | | 0.1 | | | | 21 | 3.7 | 24.2 | 0.03 |
| 17 | 12 | 1.3 | 1.36 | 0.9 | | | 0.05 | | | 0.5 | | 23 | 1.6 | 27.6 | 1.8 |
| 18 | 11 | 1.1 | 0.6 | | 0.1 | | | | 0.3 | | | 24 | 1.8 | 20.1 | 3.5 |
| Comparative sample | | | | | | | | | | | | | | | |
| 11 | 2 | 1.1 | 0.8 | | 2.1 | | | | | | 4.9 | 15.3 | 0.5 | 18.6 | 2.1 |
| 12 | 5 | 0.3 | 0.6 | 1.2 | | | | 0.3 | | 2.1 | | 34.1 | 1.6 | 19.2 | 2.8 |
| 13 | 25 | 3.1 | 0.8 | | | 1.3 | | | | | 5.3 | 25.1 | 3.3 | 15.6 | 2.8 |
| 14 | 12 | 6.0 | 1.4 | | 3.5 | | | | 1.3 | | | 36.5 | 1.6 | 16.2 | 0.9 |
| 15 | 18 | 6.0 | 1.9 | 1.6 | | | 0.25 | | | | 1.3 | 20.3 | 5.6 | 16.7 | 2.7 |
| 16 | 11 | 0.9 | 0.8 | | | 1.2 | | | | | | 30.8 | 1.2 | 16.7 | 7 |
| 17 | 10 | 2.3 | 5.0 | | 1.2 | | | | | 1.3 | | 29 | 3.1 | 21.4 | 4.9 |
| 18 | 8 | 0.9 | 1.5 | | | | 0.05 | | | | | 30.6 | 1.1 | 18.4 | 3.4 |
| 19 | 13 | 2.1 | 0.8 | | | 2.1 | | | | | 4.1 | 33.4 | 2.8 | 15.5 | 3.1 |
| 20 | 10 | 3.2 | 0.4 | 1.4 | | | | | 1.7 | | | 29.6 | 3.4 | 14.1 | 1.7 |

*Corrosion weight loss: Good when 20 g/m$^2$ or less.

TABLE 3

(Continued from Table 2)

| | Outer plated layer | | | | | Winding test | | |
|---|---|---|---|---|---|---|---|---|
| | Thickness μm | Cooled structure | Structure | Volume percentage of β phase % | Corrosion weight loss g/m$^2$ | Crack | Exfolation | Dross formation in plating bath |
| Inventive sample | | | | | | | | |
| 10 | 13.5 | Columnar crystal | α/β/Ternary eutectic | 10 | 19 | o | o | o |
| 11 | 16.5 | Columnar crystal | α/β/Ternary eutectic | 17 | 15 | o | o | o |
| 12 | 25.2 | Columnar crystal | α/β/Ternary eutectic | 15 | 10 | o | o | o |
| 13 | 13.3 | Columnar crystal | α/β/Ternary eutectic | 19 | 13 | o | o | o |
| 14 | 29.1 | Columnar crystal | α/β/Ternary eutectic | 16 | 14 | o | o | o |
| 15 | 25.6 | Granular crystal | α/β/Ternary eutectic | 13 | 8 | o | o | o |
| 16 | 25.6 | Granular crystal | α/β/Ternary eutectic | 12 | 14 | o | o | o |
| 17 | 43.3 | Granular crystal | α/β/Ternary eutectic | 14 | 8 | o | o | o |
| 18 | 30.4 | Columnar crystal | α/β/Ternary eutectic | 13 | 7 | o | o | o |
| Comparative sample | | | | | | | | |
| 11 | 20 | Columnar crystal | α/β/Ternary eutectic | 7 | x45 | x | o | o |
| 12 | 10 | Columnar crystal | α/β/Ternary eutectic | 15 | x27 | x | o | o |
| 13 | 2.3 | Columnar crystal | α/β/Ternary eutectic | 7 | x48 | x | o | o |

TABLE 3-continued (Continued from Table 2)

| | Outer plated layer | | | | | | | |
|---|---|---|---|---|---|---|---|---|
| | Thickness | | | Volume percentage of β phase | Corrosion weight loss | Winding test | | Dross formation |
| | μm | Cooled structure | Structure | % | g/m² | Crack | Exfolation | in plating bath |
| 14 | 42 | Granular crystal | α/β/Ternary eutectic | 16 | x30 | o | o | x |
| 15 | 10 | Granular crystal | α/β/Ternary eutectic | 7 | x35 | o | o | o |
| 16 | 15 | Granular crystal | α/β/Ternary eutectic | 12 | 14 | x | x | o |
| 17 | 60 | Columnar crystal | α/β/Ternary eutectic | 9 | 13 | x | x | o |
| 18 | 8 | Columnar crystal | α/β/Ternary eutectic | x23 | x46 | o | o | o |
| 19 | 10 | Granular crystal | α/β/Ternary eutectic | x26 | x62 | o | o | o |
| 20 | 20 | Granular crystal | α/β/Ternary eutectic | x35 | x38 | o | o | o |

*Corrosion weight loss: Good when 20 g/m² or less.

Example 3

JIS G 3505 SWRM6 steel wires 4 mm in diameter plated with pure zinc were plated additionally with a Zn—Al—Mg zinc alloy under the conditions shown in Table 1 and their characteristics were evaluated. As comparative samples, the same steel wires were plated using different plating compositions and Fe—Zn alloy layers, and their characteristics were evaluated likewise. The structure of the plating was observed with an EPMA at a polished C section surface of the plated steel wires. A 2 μm diameter beam was used for the quantitative analysis of the alloy layer composition. Corrosion resistance was evaluated in a 250-hr. continuous salt spray test, wherein corrosion weight loss per unit area of the plating was calculated from the difference between the weights before and after the test. The sample showing a corrosion weight loss of 20 g/m² or less was evaluated as good (marked with O in the table, otherwise marked with x).

Workability was evaluated by winding the sample plated wires around a 6-mm diameter steel rod in 6 rounds and visually inspecting the occurrence or otherwise of cracks on the plating surface. Exfolation of the plating was visually observed by applying an adhesive tape onto the surface of a sample wire after the cracking evaluation and peeling it off. A sample having 1 crack or none or no exfolation of the plating was evaluated as good (marked with O in the table, otherwise it was marked with x).

Table 4 shows the relationship of the average plating composition, the composition and thickness of the inner and outer alloy layers, the thickness and structure of the plated layer and the volume percentage of the β phase with corrosion resistance, workability and dross formation in the plating bath.

Any of the samples according to the present invention showed good corrosion resistance and workability and also small dross formation.

In comparative samples 1 to 7, the composition of the plating alloy did not conform to that is stipulated in the present invention: in comparative samples 1 to 3, the content of Al, Mg or Si was lower than the relevant lower limit according to the present invention and, consequently, corrosion resistance was poor; in comparative samples 4 to 6, the content of Al, Mg or Si was higher than the relevant upper limit according to the present invention and, consequently, corrosion resistance was poor. So much dross was formed in the plating of the comparative samples 4 to 6 that the plating operation was hindered. In comparative samples 8 and 9, the thickness of the plated alloy layer was outside the range specified in the present invention, and workability was poor. In comparative samples 10 to 12, the volume percentage of the β phase in the plating structure was outside the range specified in the present invention, and corrosion resistance was poor.

TABLE 4

| | Average plating composition | | | | Inner Alloy layer | | | | | Outer alloy layer | | | | | Plated layer | | | | Corrosion weight loss | Winding test | | Dross formation in plating bath |
|---|---|---|---|---|---|---|---|---|---|---|---|---|---|---|---|---|---|---|---|---|---|---|
| | Al % | Mg % | Si % | Fe % | Al % | Mg % | Si % | Fe % | Thickness μm | Al % | Mg % | Si % | Fe % | Thickness μm | Thickness μm | Cooled structure | Structure | Volume percentage of β phase % | g/m² | Crack | Exfoliation | |
| Inventive Sample | | | | | | | | | | | | | | | | | | | | | | |
| 1 | 4 | 2.8 | 1.01 | 0.92 | 21 | 3.6 | 4.2 | 15.3 | 4.6 | 19 | 3.6 | 2.5 | 24.6 | 29.3 | 13.5 | Columnar crystal | α/β/Ternary eutectic | 10 | 19 | o | o | o |
| 2 | 20 | 1.5 | 0.5 | 0.08 | 26 | 1.7 | 2.1 | 23.2 | 1.4 | 26 | 1.7 | 3.4 | 11.0 | 12.7 | 16.5 | Columnar crystal | α/β/Ternary eutectic | 17 | 15 | o | o | o |
| 3 | 6 | 0.9 | 1.16 | 0.69 | 23 | 1.3 | 6.9 | 27.8 | 4.9 | 23 | 1.3 | 3.0 | 23.8 | 13.2 | 25.2 | Columnar crystal | α/β/Ternary eutectic | 15 | 10 | o | o | o |
| 4 | 8 | 4.8 | 1.73 | 0.88 | 21 | 4.5 | 3.4 | 25.7 | 2.4 | 21 | 4.5 | 2.1 | 14.5 | 25.3 | 13.3 | Columnar crystal | α/β/Ternary eutectic | 19 | 13 | o | o | o |
| 5 | 11 | 1.1 | 0.02 | 0.26 | 22 | 1.2 | 6.4 | 22.2 | 0.9 | 22 | 1.2 | 2.1 | 29.2 | 9.1 | 34.7 | Granular crystal | α/β/Ternary eutectic | 15 | 11 | o | o | o |
| 6 | 13 | 3.1 | 1.9 | 0.78 | 20 | 3.3 | 3.1 | 18.5 | 1.0 | 20 | 3.3 | 2.7 | 4.1 | 13.4 | 2.3 | Granular crystal | α/β/Ternary eutectic | 11 | 5 | o | o | o |
| 7 | 17 | 0.9 | 1.13 | 0.02 | 25 | 1.5 | 3.0 | 25.6 | 0.9 | 25 | 1.5 | 3.8 | 11.9 | 18.2 | 29.1 | Granular crystal | α/β/Ternary eutectic | 16 | 14 | o | o | o |
| 8 | 19 | 3 | 1.95 | 1.99 | 27 | 3.6 | 4.3 | 21.8 | 2.6 | 27 | 3.6 | 2.8 | 3.2 | 18.6 | 25.6 | Granular crystal | α/β/Ternary eutectic | 13 | 8 | o | o | o |
| 9 | 10 | 1.1 | 1.13 | 0.55 | 21 | 3.7 | 2.9 | 24.2 | 0.03 | 21 | 3.7 | 3.5 | 3.3 | 8.4 | 25.6 | Granular crystal | α/β/Ternary eutectic | 12 | 14 | o | o | o |
| 10 | 12 | 1.3 | 1.96 | 1.36 | 23 | 1.6 | 2.3 | 27.6 | 1.8 | 23 | 1.6 | 2.5 | 16.6 | 4.3 | 43.3 | Columnar crystal | α/β/Ternary eutectic | 14 | 8 | o | o | o |
| 11 | 11 | 1.1 | 1.33 | 0.6 | 24 | 1.8 | 3.0 | 20.1 | 3.5 | 24 | 1.8 | 3.1 | 27.2 | 7.9 | 30.4 | Columnar crystal | α/β/Ternary eutectic | 13 | 7 | o | o | o |
| Comparative Sample | | | | | | | | | | | | | | | | | | | | | | |
| 1 | 2 | 1.1 | 0.1 | 0.8 | 15.3 | 0.5 | 2.5 | 18.6 | 2.1 | 10.9 | 0.7 | 2.4 | 4.8 | 6.8 | 20 | Columnar crystal | α/β/Ternary eutectic | 7 | x45 | o | o | o |
| 2 | 5 | 0.3 | 0.1 | 0.6 | 34.1 | 1.6 | 2.2 | 19.2 | 2.8 | 6.4 | 0.4 | 2.1 | 18 | 14.3 | 10 | Columnar crystal | α/β/Ternary eutectic | 15 | x27 | o | o | o |
| 3 | 7 | 2.0 | 0.007 | 1.1 | 30.7 | 5.3 | 2.7 | 21 | 1.4 | 28.9 | 1.1 | 2.3 | 1 | 28.9 | 11 | Columnar crystal | α/β/Ternary eutectic | 13 | x23 | o | o | o |
| 4 | 25 | 3.1 | 1.9 | 0.8 | 25.1 | 3.3 | 3.1 | 15.6 | 2.8 | 15.4 | 4.7 | 2.8 | 17.1 | 7.3 | 2.3 | Columnar crystal | α/β/Ternary eutectic | 7 | x48 | o | o | o |
| 5 | 12 | 6.0 | 2 | 1.4 | 36.5 | 1.6 | 2.3 | 16.2 | 0.9 | 29.6 | 4.2 | 3.3 | 6.3 | 23.3 | 42 | Granular crystal | α/β/Ternary eutectic | 16 | x30 | o | o | x |
| 6 | 17 | 3.0 | 0.8 | 0.1 | 26.5 | 3.4 | 2 | 22.4 | 3.9 | 23.8 | 4.5 | 2.2 | 8.8 | 5.3 | 30 | Granular crystal | α/β/Ternary eutectic | 3 | x23 | o | o | o |
| 7 | 18 | 6.0 | 1.9 | 1.9 | 20.3 | 5.6 | 3.5 | 16.7 | 2.7 | 1.4 | 4 | 2.2 | 7.4 | 24.8 | 10 | Granular crystal | α/β/Ternary eutectic | 7 | x35 | o | o | o |

TABLE 4-continued

| | Average plating composition | | | | Inner Alloy layer | | | | | Outer alloy layer | | | | | Plated layer | | | | Corrosion | Winding test | | Dross formation in |
|---|---|---|---|---|---|---|---|---|---|---|---|---|---|---|---|---|---|---|---|---|---|---|
| | Al % | Mg % | Si % | Fe % | Al % | Mg % | Si % | Fe % | Thickness μm | Al % | Mg % | Si % | Fe % | Thickness μm | Thickness μm | Cooled structure | Structure | Volume percentage of β phase % | weight loss g/m$^2$ | Crack | Exfoliation | plating bath |
| 8 | 11 | 0.9 | 0.002 | 0.8 | 30.8 | 1.2 | 3.7 | 16.7 | x7 | 19.4 | 2.5 | 2.6 | 16.1 | 25 | 15 | Granular crystal | α/β/Ternary eutectic | 12 | 14 | x | x | o |
| 9 | 10 | 2.3 | 0.2 | 5.0 | 29 | 3.1 | 3.9 | 21.4 | 4.9 | 8.1 | 1.5 | 2.1 | 17.5 | x35 | 60 | Columnar crystal | α/β/Ternary eutectic | 9 | 13 | x | x | o |
| 10 | 8 | 0.9 | 0.9 | 1.5 | 30.6 | 1.1 | 3.3 | 18.4 | 3.4 | 25.4 | 0.7 | 2.6 | 3.8 | 12.7 | 8 | Columnar crystal | α/β/Ternary eutectic | x23 | x46 | o | o | o |
| 11 | 13 | 2.1 | 1.3 | 0.8 | 33.4 | 2.8 | 2.2 | 15.5 | 3.1 | 1.9 | 2.6 | 2.3 | 12.4 | 14.4 | 10 | Granular crystal | α/β/Ternary eutectic | x26 | x62 | o | o | o |
| 12 | 10 | 3.2 | 0.7 | 0.4 | 29.6 | 3.4 | 2.9 | 14.1 | 1.7 | 11.3 | 3.4 | 2.5 | 15.3 | 13.6 | 20 | | α/β/Ternary eutectic | x35 | x38 | o | o | o |

Example 4

JIS G 3505 SWRM6 steel wires 4 mm in diameter plated with pure zinc were plated additionally with a Zn—Al—Mg zinc alloy under the conditions shown in Table 1 and their characteristics were evaluated. As-comparative samples, the same steel wires were plated using different plating compositions and Fe—Zn alloy layers, and their characteristics were evaluated likewise. The structure of the plating was observed with an EPMA at a polished C section surface of the plated steel wires. A 2-$\mu$m diameter beam was used for the quantitative analysis of the alloy layer composition. Corrosion resistance was evaluated in a 250-hr. continuous salt spray test, wherein corrosion weight loss per unit area of the plating was calculated from the difference between the weights before and after the test. A sample showing a weight loss of 20 gl/m$^2$ or less was evaluated as good (marked with O in the table, otherwise it was marked with x).

Workability was evaluated by winding the sample plated wires around a 6-mm diameter steel rod in 6 rounds and visually inspecting the occurrence or otherwise of cracks on the plating surface. Exfolation of the plating was visually observed by applying an adhesive tape onto the surface of a sample wire after the cracking evaluation and peeling it off. A sample having 1 crack or none and no exfolation of the plating was evaluated as good (marked with O in the table, otherwise it was marked with x).

Table 5 shows the relationship of the average plating composition, the composition and thickness of the inner and outer alloy layers, the thickness and structure of the plated layer and the volume percentage of the β phase with corrosion resistance, workability and dross formation in the plating bath. Any of the samples according to the present invention showed good corrosion resistance and workability and also small dross formation.

In comparative samples 13 to 19, the composition of the plating alloy did not conform to that stipulated in the present invention: in comparative samples 13 to 15, the content of Al, Mg or Si was lower than the relevant lower limit according to the present invention and, consequently, corrosion resistance was poor; in comparative samples 16 to 18 and 19, the content of Al, Mg or Si was higher than the relevant upper limit according to the present invention and, consequently, corrosion resistance was poor. So much dross was formed in the plating of the comparative samples 16 to 18 and 19 that plating operation was hindered. In comparative samples 20 and 21, the thickness of the plated alloy layer was outside the range specified in the present invention, and workability was poor. In comparative samples 22 to 24, the volume percentage of the β phase in the plating structure was outside the range specified in the present invention, and corrosion resistance was poor.

TABLE 5

| | Average plating composition (mass %) | | | | | | | | | | | Inner alloy layer Composition (mass %) | | | | Inner alloy layer Thickness |
|---|---|---|---|---|---|---|---|---|---|---|---|---|---|---|---|---|
| | Al | Mg | Si | Fe | Na | Ca | Ti | Mo | $N^2O$ | Cr | Sn | Al | Mg | Si | Fe | ($\mu$m) |
| Inventive Sample | | | | | | | | | | | | | | | | |
| 12 | 4 | 2.96 | 0.7913 | 0.62 | 0.23 | | | | | | 0.4 | 21 | 3.6 | 4.2 | 15.3 | 4.6 |
| 13 | 19 | 1.88 | 0.1725 | 0.48 | | 0.45 | | | 0.18 | | | 26 | 1.7 | 2.1 | 23.2 | 1.4 |
| 14 | 4.46 | 1.38 | 1.0883 | 0.75 | | | 0.18 | | | | | 23 | 1.3 | 6.9 | 27.8 | 4.9 |
| 15 | 7.99 | 4.62 | 1.6238 | 0.96 | | 0.22 | | 0.1 | | | | 21 | 4.5 | 3.4 | 25.7 | 2.4 |
| 16 | 11.5 | 1.29 | 0.002 | 0.02 | 0.05 | | 0.92 | | | 0.05 | | 22 | 1.2 | 6.4 | 22.2 | 0.9 |
| 17 | 14 | 3.44 | 1.5439 | 0.3 | | | 0.23 | | | | | 20 | 3.3 | 3.1 | 18.5 | 1.0 |
| 18 | 18 | 1.27 | 1.5812 | 0.04 | | 0.19 | | | | | 0.18 | 25 | 1.5 | 3.0 | 25.6 | 0.9 |
| 19 | 17.9 | 2.79 | 1.78 | 1.63 | 0.43 | | | | | | | 27 | 3.6 | 4.3 | 21.8 | 2.6 |
| 20 | 11.8 | 0.92 | 0.677 | 0.24 | | 0.77 | | 0.1 | | 0.4 | | 21 | 3.7 | 2.9 | 24.2 | 0.03 |
| 21 | 12.9 | 3.21 | 1.94 | 0.91 | 0.88 | | | | | | | 23 | 1.6 | 2.3 | 27.6 | 1.8 |
| 22 | 12.1 | 2.9 | 1.758 | 0.43 | | | 0.06 | | | | 0.2 | 24 | 1.8 | 3.0 | 20.1 | 3.5 |
| Comparative Sample | | | | | | | | | | | | | | | | |
| 13 | 2 | 1.1 | 0.1 | 0.8 | 1.5 | | | | | | | 15.3 | 0.5 | 2.5 | 18.6 | 2.1 |
| 14 | 5 | 0.3 | 0.1 | 0.6 | | | 1.2 | | | | | 34.1 | 1.6 | 2.2 | 19.2 | 2.8 |
| 15 | 7 | 2.0 | 0.007 | 1.1 | | | | 0.5 | | | | 30.7 | 5.3 | 2.7 | 21 | 1.4 |
| 16 | 25 | 3.1 | 1.9 | 0.8 | | 2.1 | | | | | | 25.1 | 3.3 | 3.1 | 15.6 | 2.8 |
| 17 | 12 | 6.0 | 2 | 1.4 | | | | | 0.3 | | | 36.5 | 1.6 | 2.3 | 16.2 | 0.9 |
| 18 | 17 | 3.0 | 0.8 | 0.1 | 1.3 | | | | | | 0.2 | 26.5 | 3.4 | 2 | 22.4 | 3.9 |
| 19 | 18 | 6.0 | 1.9 | 1.9 | | 1.2 | | | | | | 20.3 | 5.6 | 3.5 | 16.7 | 2.7 |
| 20 | 11 | 0.9 | 0.002 | 0.8 | | | 1.5 | | | | | 30.8 | 1.2 | 3.7 | 16.7 | x7 |
| 21 | 10 | 2.3 | 0.2 | 5.0 | | | | | | 0.6 | | 29 | 3.1 | 3.9 | 21.4 | 4.9 |
| 22 | 8 | 0.9 | 0.9 | 1.5 | | 2.3 | | | | | | 30.6 | 1.1 | 3.3 | 18.4 | 3.4 |
| 23 | 13 | 2.1 | 1.3 | 0.8 | 1.3 | | | | | | | 33.4 | 2.8 | 2.2 | 15.5 | 3.1 |
| 24 | 10 | 3.2 | 0.7 | 0.4 | | | | | | | 3.0 | 29.6 | 3.4 | 2.9 | 14.1 | 1.7 |

TABLE 5-continued

| | Outer alloy layer | | | | | Plated layer | | | | | | |
|---|---|---|---|---|---|---|---|---|---|---|---|---|
| | Composition (mass %) | | | | Thickness | Thickness | Cooled | | Volume percentage of β phase | Corrosion weight loss | Winding test | | Dross formation in plating bath |
| | Al | Mg | Si | Fe | (μm) | (μm) | structure | Structure | (%) | | Crack | Exfolation | |
| Inventive Sample | | | | | | | | | | | | | |
| 12 | 19 | 3.6 | 2.5 | 24.5 | 29.3 | 13.5 | Granular crystal | α/β/Ternary eutectic | 10 | 19 | o | o | o |
| 13 | 26 | 1.7 | 3.4 | 11.0 | 12.7 | 16.5 | Granular crystal | α/β/Ternary eutectic | 17 | 15 | o | o | o |
| 14 | 23 | 1.3 | 3.0 | 23.8 | 13.2 | 25.2 | Granular crystal | α/β/Ternary eutectic | 15 | 10 | o | o | o |
| 15 | 21 | 4.5 | 2.1 | 14.5 | 25.3 | 13.3 | Granular crystal | α/β/Ternary eutectic | 19 | 13 | o | o | o |
| 16 | 22 | 1.2 | 2.1 | 29.2 | 9.1 | 34.7 | Columnar crystal | α/β/Ternary eutectic | 15 | 11 | o | o | o |
| 17 | 20 | 3.3 | 2.7 | 4.1 | 13.4 | 2.3 | Columnar crystal | α/β/Ternary eutectic | 11 | 5 | o | o | o |
| 18 | 25 | 1.5 | 3.8 | 11.9 | 18.2 | 29.1 | Columnar crystal | α/β/Ternary eutectic | 16 | 14 | o | o | o |
| 19 | 27 | 3.6 | 2.8 | 3.2 | 18.6 | 25.6 | Columnar crystal | α/β/Ternary eutectic | 13 | 8 | o | o | o |
| 20 | 21 | 3.7 | 3.5 | 3.3 | 8.4 | 25.6 | Granular crystal | α/β/Ternary eutectic | 12 | 14 | o | o | o |
| 21 | 23 | 1.6 | 2.5 | 16.6 | 4.3 | 43.3 | Granular crystal | α/β/Ternary eutectic | 14 | 8 | o | o | o |
| 22 | 24 | 1.8 | 3.1 | 27.2 | 7.9 | 30.4 | Granular crystal | α/β/Ternary eutectic | 13 | 7 | o | o | o |
| Comparative Sample | | | | | | | | | | | | | |
| 13 | 10.9 | 0.7 | 2.4 | 4.8 | 6.8 | 20 | Granular crystal | α/β/Ternary eutectic | 7 | x45 | x | o | o |
| 14 | 6.4 | 0.4 | 2.1 | 18 | 14.3 | 10 | Granular crystal | α/β/Ternary eutectic | 15 | x27 | x | o | o |
| 15 | 28.9 | 1.1 | 2.3 | 1 | 28.9 | 11 | Granular crystal | α/β/Ternary eutectic | 13 | x23 | o | o | o |
| 16 | 15.4 | 4.7 | 2.8 | 17.1 | 7.3 | 2.3 | Granular crystal | α/β/Ternary eutectic | 7 | x48 | x | o | o |
| 17 | 29.6 | 4.2 | 3.3 | 6.3 | 23.3 | 42 | Columnar crystal | α/β/Ternary eutectic | 16 | x30 | o | o | x |
| 18 | 23.8 | 4.5 | 2.2 | 8.8 | 5.3 | 30 | Columnar crystal | α/β/Ternary eutectic | 3 | x23 | o | o | o |
| 19 | 1.4 | 4 | 2.2 | 7.4 | 24.8 | 10 | Columnar crystal | α/β/Ternary eutectic | 7 | x35 | o | o | o |
| 20 | 19.4 | 2.5 | 2.6 | 16.1 | 25 | 15 | Columnar crystal | α/β/Ternary eutectic | 12 | 14 | x | x | o |
| 21 | 8.1 | 1.5 | 2.1 | 17.5 | x35 | 60 | Granular crystal | α/β/Ternary eutectic | 9 | 13 | x | x | o |
| 22 | 25.4 | 0.7 | 2.6 | 3.8 | 12.7 | 8 | Granular crystal | α/β/Ternary eutectic | x23 | x46 | o | o | o |
| 23 | 1.9 | 2.6 | 2.3 | 12.4 | 14.4 | 10 | Columnar crystal | α/β/Ternary eutectic | x26 | x62 | o | o | o |
| 24 | 11.3 | 3.4 | 2.5 | 15.3 | 13.6 | 20 | Columnar crystal | α/β/Ternary eutectic | x35 | x38 | x | o | o |

INDUSTRIAL APPLICABILITY

As explained above, a galvanized steel material, a galvanized steel wire in particular, excellent in corrosion resistance and workability is obtained by applying the present invention.

What is claimed is:

1. A plated steel material excellent in corrosion resistance and workability, characterized by having an alloy layer 20 μm or less in thickness consisting of, in mass, 25% or less of Fe, 30% or less of Al, 5% or less of Mg and the balance consisting of Zn at the interface of a plated layer and a base steel.

2. A plated steel material excellent in corrosion resistance and workability, characterized by having: an alloy layer 20 μm or less in thickness consisting of, in mass, 25% or less-of Fe, 30% or less of Al, 5% or less of Mg and the balance consisting of Zn at the interface of a plated layer and a base steel; and the plated layer consisting of, as an average composition in mass, 4 to 20% of Al, 0.8 to 5% of Mg, 2% or less of Fe and the balance consisting of Zn on top of the alloy layer.

3. A plated steel material excellent in corrosion resistance and workability, characterized by having, at the interface of a plated layer and a base steel, an alloy layer composed of:

an inner alloy layer 5 μm or less in thickness consisting of, in mass, 15% or more of Fe, 20% or more of Al, 2% or more of Si, 5% or less of Mg and the balance consisting of Zn; and an outer alloy layer 30 μm or less in thickness consisting of, in mass, 25% or less of Fe, 30% or less of Al, 2% or more of Si, 5% or less of Mg and the balance consisting of Zn.

4. A plated steel material excellent in corrosion resistance and workability, characterized by having: at the interface of a plated layer and a base steel, an alloy layer composed of an inner alloy layer 5 μm or less in thickness consisting of, in mass, 15% or more of Fe, 20% or more of Al, 2% or more of Si, 5% or less of Mg and the balance consisting of Zn and an outer alloy layer 30 pn or less in thickness consisting of, in mass, 25% or less of Fe, 30% or less of Al, 2% or more of Si, 5% or less of Mg and the balance consisting of Zn; and, on top of the outer alloy layer, the plated layer consisting of, as an average composition in mass, 4 to 20% of Al, 0.8 to 5% of Mg, 0.01 to 2% of Si, 2% or less of Fe and the balance consisting of Zn, and containing $Mg_2Si$ dispersively existing therein.

5. A plated steel material excellent in corrosion resistance and workability according to claim 2, characterized in that the solidification structure of the plated layer is a granular crystal structure or a columnar crystal structure.

6. A plated steel material excellent in corrosion resistance and workability according to claim 2, characterized in that each of an α phase mainly composed of Al—Zn, a β phase consisting of Zn only or an Mg—Zn alloy layer and a Zn—Al—Mg ternary eutectic phase exists in the structure of the plated layer.

7. A plated steel material excellent in corrosion resistance and workability according to claim 4, characterized in that each of an α phase mainly composed of Al—Zn, a β phase consisting of Zn only or an Mg—Zn alloy layer and a Zn—Al—Mg ternary eutectic phase exists in the structure of the plated layer.

8. A plated steel material excellent in corrosion resistance and workability according to claim 6 or 7, characterized in that the volume percentage of the β phase existing in the structure of the plated layer is 20% or less.

9. A plated steel material excellent in corrosion resistance and workability according to claim 2, characterized in that the plated layer further contains one or more of the elements selected from among one or more of the groups of a, b, c, and d below;

a: one or more elements of Ti, Li, Be, Na, K, Ca, Cu, La and Hf in 0.01 to 1.0 mass % each;

b: one or more elements of Mo, W, Nb and Ta in 0.01 to 0.2 mass % each, c: one or more elements of Pb and Bi in 0.01 to 0.2 mass % each d: one or more elements of Sr, V, Cr, Mn and Sn in 0.01 to 0.5 mass % each.

10. A plated steel material excellent in corrosion resistance and workability according to claim 4, characterized in that the plated layer further contains one or more of the elements selected from among one or more of the groups of a, b, c, and d below;

a: one or more elements of Ti, Li, Be, Na, K, Ca, Cu, La and Hf in 0.01 to 1.0 mass % each;

b: one or more elements of Mo, W, Nb and Ta in 0.01 to 0.2 mass % each, c: one or more elements of Pb and Bi in 0.01 to 0.2 mass % each d: one or more elements of Sr, V, Cr, Mn and Sn in 0.01 to 0.5 mass % each.

11. A plated steel material excellent in corrosion resistance and workability according to claim 1, characterized in that the plated steel material further has any one of a paint coating and a heavy anticorrosion coating.

12. A plated steel material excellent in corrosion resistance and workability according to claim 2, characterized in that the plated steel material further has any one of a paint coating and a heavy anticorrosion coating.

13. A plated steel material excellent in corrosion resistance and workability according to claim 3, characterized in that the plated steel material further has any one of a paint coating and a heavy anticorrosion coating.

14. A plated steel material excellent in corrosion resistance and workability according to claim 4, characterized in that the plated steel material further has any one of a paint coating and a heavy anticorrosion coating.

15. A plated steel material excellent in corrosion resistance and workability according to any one of claims 11 to 14 characterized in that the heavy anticorrosion coating consists of one or more of the high molecular compounds selected from among vinyl chloride, polyethylene, polyurethane and fluororesin.

16. A plated steel material excellent in corrosion resistance and workability according to claim 1, characterized in that the plated steel material is a plated steel wire.

17. A plated steel material excellent in corrosion resistance and workability according to claim 2, characterized in that the plated steel material is a plated steel wire.

18. A plated steel material excellent in corrosion resistance and workability according to claim 3, characterized in that the plated steel material is a plated steel wire.

19. A plated steel material excellent in corrosion resistance and workability according to claim 4, characterized in that the plated steel material is a plated steel wire.

20. A method to produce a plated steel material excellent in corrosion resistance and workability, characterized by: applying to a steel material a hot dip galvanizing containing, in mass, 3% or less of Al and 0.5% or less of Mg as the first step, and then a hot dip alloy plating consisting of, as an average composition in mass, 4 to 20% of Al, 0.8 to 5% of Mg, 2% or less of Fe and the balance consisting of Zn as the second step, so as to form an alloy layer 20 μm or less in thickness consisting of, in mass, 25% or less of Fe, 30% or less of Al, 5% or less of Mg and the balance consisting of Zn at the interface of a plated layer and a base steel; and then making the solidification structure of the plated layer a granular crystal structure by cooling the plated steel material at a cooling rate of 300° C./sec. or less or a columnar crystal structure by cooling the plated steel material at a cooling rate of 300° C./sec. or more.

21. A method to produce a plated steel material excellent in corrosion resistance and workability, characterized by: applying to a steel material a hot dip galvanizing containing, in mass, 3% or less of Al and 0.5% or less of Mg as the first step, and then a hot dip alloy plating consisting of, as an average composition in mass, 4 to 20% of Al, 0.8 to 5% of Mg, 0.01 to 2% of Si, 2% or less of Fe and the balance consisting of Zn as the second step, so as to form an alloy layer composed of an inner alloy layer 5 μm or less in thickness consisting of, in mass, 15% or more of Fe, 20% or more of Al, 2% or more of Si, 5% or less of Mg and the balance consisting of Zn and an outer alloy layer 30 μm or less in thickness consisting of, in mass, 25% or less of Fe, 30% or less of Al, 2% or more of Si, 5% or less of Mg and the balance consisting of Zn at the interface of a plated layer and a base steel; and then making the solidification structure of the plated layer a granular crystal structure by cooling the plated steel material at a cooling rate of 300° C./sec. or less or a columnar crystal structure by cooling the plated steel material at a cooling rate of 300° C./sec. or more.

22. A method to produce a plated steel material excellent in corrosion resistance and workability according to claim 20, characterized in that the hot dip alloy plating of the second step further contains one or more of the elements selected from among one or more of the groups of a, b, c and d below;

a: one or more elements of Ti, Li, Be, Na, K, Ca, Cu, La and Hf in 0.01 to 1.0 mass % each, b: one or more elements of Mo, W, Nb, and Ta in 0.01 to 0.2 mass % each, c: one or more elements of Pb and Bi in 0.01 to 0.2 mass % each, d: one or more elements of Sr, V, Cr, Mn, and Sn in 0.01 to 0.5 mass % each.

23. A method to produce a plated steel material excellent in corrosion resistance and workability according to claim 21, characterized in that the hot dip alloy plating of the second step further contains one or more of the elements selected from among one or more of the groups of a, b, c and d below;

a: one or more elements of Ti, Li, Be, Na, K, Ca, Cu, La and Hf in 0.01 to 1.0 mass % each, b: one or more elements of Mo, W, Nb, and Ta in 0.01 to 0.2 mass % each, c: one or more elements of Pb and Bi in 0.01 to 0.2 mass % each, d: one or more elements of Sr, V, Cr, Mn, and Sn in 0.01 to 0.5 mass % each.

24. A method to produce a plate steel material excellent in corrosion resistance and workability according to claim 20, characterized by: conducting the first step hot dip galvanizing at an immersion time of 20 sec. Or less in a plating bath and then the second step hot dip zinc alloy plating at an immersion time of 20 sec. or less in another plating bath; and, at both the first and second steps of the plating, purging the areas where the steel material is pulled out of the plating baths with nitrogen gas in order to prevent the plating bath surface and the plated steel material from oxidizing.

25. A method to produce a plated steel material excellent in corrosion resistance and workability according to claim 21, characterized by: conducting the first step hot dip galvanizing at an immersion time of 20 sec. Or less in a plating bath and then the second step hot dip zinc alloy plating at an immersion time of 20 sec. or less in another plating bath; and, at both the first and second steps of the plating, purging the areas where the steel material is pulled out of the plating baths with nitrogen gas in order to prevent the plating bath surface and the plated steel material from oxidizing.

26. A method to produce a plated steel material excellent in corrosion resistance and workability according to claim 20, characterized by solidifying the plated alloy by direct cooling using any one of the cooling means of water spray, gas-atomized water spray or water flow immediately after the plated steel material is pulled up from the plating bath of the second step hot dip zinc alloy plating.

27. A method to produce a plate steel material excellent in corrosion resistance and workability according to claim 21, characterized by solidifying the plated alloy by direct cooling using any one of the cooling means of water spray, gas-atomized water spray or water flow immediately after the plated steel material is pulled up from the plating bath of the second step hot dip zinc alloy plating.

28. A method to produce a plated steel material excellent in corrosion resistance and workability according to claim 20, characterized by commencing the cooling of the plated steel material at a temperature 20° C. or less above the melting point of the plating alloy.

29. A method to produce a plated steel material excellent in corrosion resistance and workability according to claim 21, characterized by commencing the cooling of the plated steel material at a temperature 20° C. or less above the melting point of the plating alloy.

30. A method to produce a plated steel material excellent in corrosion resistance and workability according to claim 20, characterized in that the plated steel material is a plated steel wire.

31. A method to produce a plated steel material excellent in corrosion resistance and workability according to claim 21, characterized in that the plated steel material is a plated steel wire.

* * * * *